United States Patent [19]

Wise

[11] 4,176,995

[45] Dec. 4, 1979

[54] AUTOMATIC PICKUP AND UNLOADING CRANE

[75] Inventor: Cecil S. Wise, Dallas, N.C.

[73] Assignee: Fiber Controls Corporation, Gastonia, N.C.

[21] Appl. No.: 746,014

[22] Filed: Nov. 30, 1976

Related U.S. Application Data

[63] Continuation of Ser. No. 615,092, Sep. 19, 1975, abandoned, which is a continuation of Ser. No. 526,919, Nov. 25, 1974, abandoned, which is a continuation of Ser. No. 295,356, Oct. 5, 1972, abandoned.

[51] Int. Cl.[2] ..... B65G 47/00; B66C 17/00

[52] U.S. Cl. ..... 414/266; 414/303; 212/18; 340/685

[58] Field of Search ... 214/16 R, 16 B, 16.4 A–16.4 C, 214/17 C, 17 CA, 86, 89, 658; 212/18, 20–21, 124–129; 340/267 C

[56] References Cited

U.S. PATENT DOCUMENTS

| | | | |
|---|---|---|---|
| 2,412,844 | 12/1946 | Stevens | 214/16 R |
| 2,942,736 | 6/1960 | Landsiedel | 212/21 |
| 3,260,375 | 7/1966 | Lemelson | 212/127 X |
| 3,422,967 | 1/1969 | Aron | 214/16.4 A X |
| 3,477,593 | 11/1969 | Whitham | 214/16 R |
| 3,677,420 | 7/1972 | Cotton et al. | 214/16.4 A |
| 3,777,908 | 12/1973 | Keller | 214/16 R |

FOREIGN PATENT DOCUMENTS

| | | | |
|---|---|---|---|
| 3817 | of 1891 | United Kingdom | 212/18 |

*Primary Examiner*—Trygve M. Blix
*Assistant Examiner*—R. B. Johnson
*Attorney, Agent, or Firm*—Cushman, Darby & Cushman

[57] ABSTRACT

Apparatus for supplying textile fibers to each of a plurality of textile blending machines extending in a line and defining a blending line from each of a plurality of fiber bales extending behind each of the machines with an overhead crane mounted for movement vertically and in two horizontal directions by a number of motors, a sensor in the hopper of each machine for providing a demand signal when the level of material in that hopper is less than a predetermined level, and a control circuit for operating the motors to supply material in a set order to each hopper having a sensor providing a demand signal with each hopper receiving fibers from each of the bales extending behind it.

6 Claims, 5 Drawing Figures

Fig. 2
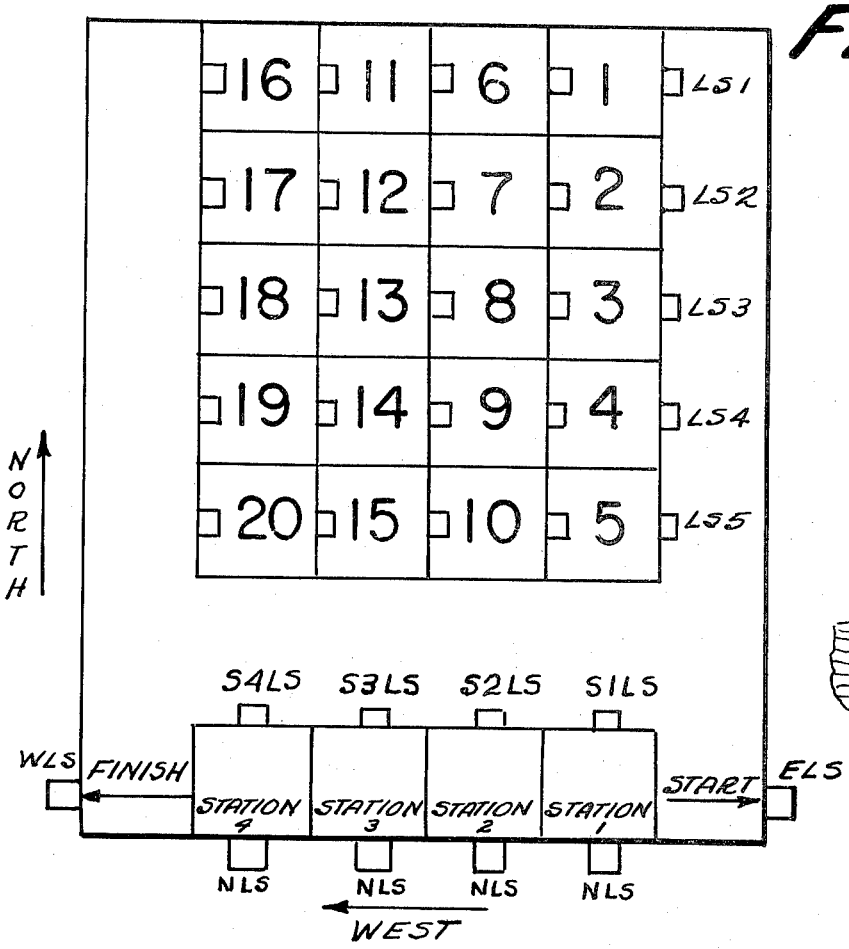
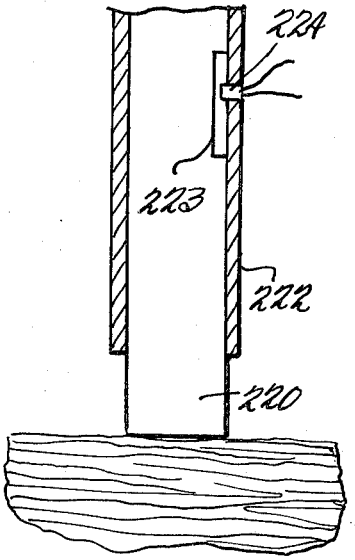
Fig. 5
Fig. 3
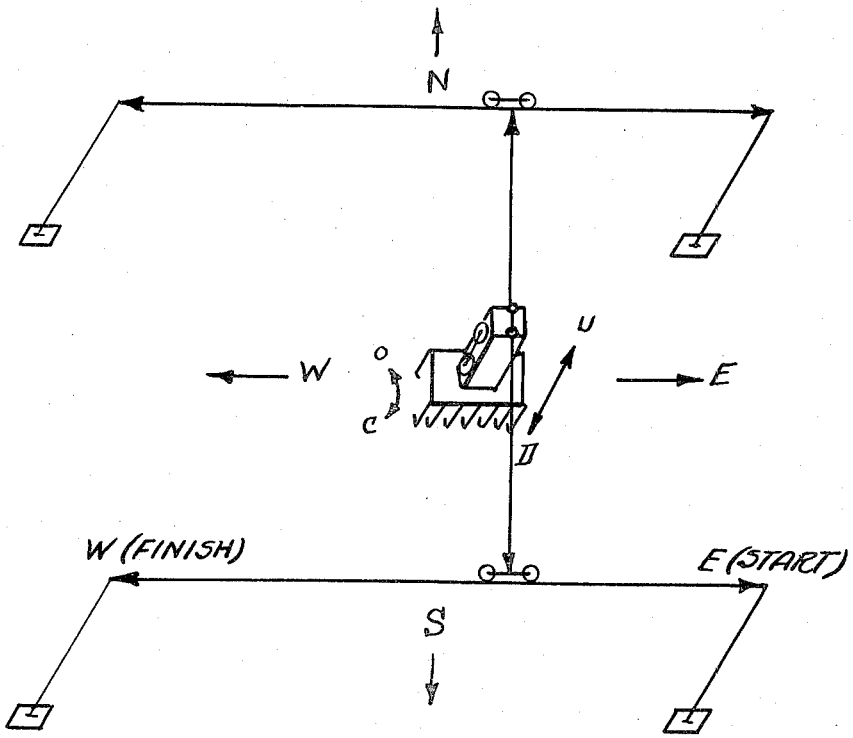

START
STOP
HOT
115V.
ELS
WLS
OLS
NLS
ULS
CLS
DLS
LS1
RC1
RC2

AUTOMATIC PICKUP AND UNLOADING CRANE

Cross Reference to Related Applications

This is a continuation of application Ser. No. 615,092 filed Sept. 19, 1975, abandoned upon the filing hereof, which was a continuation of Ser. No. 526,919, filed Nov. 25, 1974, now abandoned, which in turn was a continuation of Ser. No. 295,356, filed Oct. 5, 1972, now abandoned, the Official files of all of which are incorporated hereinto.

BRIEF DESCRIPTION OF THE PRIOR ART AND SUMMARY OF THE INVENTION

The invention relates to an apparatus for automatically supplying material to a location from which it is being removed from at least one source and to a control circuit for effecting that supply.

There are many situations in which material of one kind or another is stored at one location, such as a hopper, from which it is periodically removed. In the textile arts, such a need arises in conjunction with a fiber blending line. This type of line normally includes a plurality of blending machines, each having a weigh pan which overhangs a conveyor which is periodically moved following each dumping of the material in the pans to create fiber sandwiches which can then be pneumatically or otherwise transported to carding or other machines. The amount of material which is weighed in each pan can be carefully controlled to create any desired blend. Wise U.S. Pat. No. 3,439,838 describes a blending line of this type and suitable circuitry for controlling feeding and dumping of the weigh pans.

Material for supplying the weigh pans in this type of system is normally drawn by a conveyor from a hopper associated with each of the blending machines. Hitherto, these hoppers have been filled individually either by manually placing in each hopper a bale or a quantity of the material which that blending machine is to weigh and dump or by the use of an overhead crane. Typically, when an overhead crane is used, a number of bales are manually stacked on a platform extending behind each of the hoppers of each of the blending machines. The overhead crane is mounted for movement on a frame and has fingers which can be opened and closed to respectively pick up and dump material. The crane is mounted for movement along the length of the blending line, passing in turn each of the stacks or bales of textile fibers which extend transverse to that line. The crane is also mounted for movement transverse to the direction in which the blending line extends, and for up-and-down movement with appropriate motors controlling vertical and horizontal movement and operation of the fingers for picking up and dropping the material. This crane has in the past been manually controlled by an operator who, by pressing appropriate buttons, operates the various motors in turn to cause the crane to be moved horizontally and vertically, and to open and close to pick up and drop respectively a desired quantity of material from any of the bales extending behind the hopper of a machine which, from visual inspection, needs additional fibers to maintain continuous operation of the blending line.

This manually operated crane, while it has proven more efficient than simply having an individual physically pick up and place material in the hopper, still has a number of substantial drawbacks. One of these drawbacks, of course, is the need for an operator to be continually present and alert to filling the various hoppers. Another drawback is the time required for the individual to move the crane exactly over a chosen bale and to cause picking up and dumping of material into the appropriate hopper. There is always the danger that, because of inattention or inability to work fast enough, one or another of the hoppers may run dry with a consequent problem in the blending line or a necessitated temporary cessation of operation until all empty hoppers can be refilled.

The present invention relates to control circuitry and to an apparatus of this type employing such circuitry which senses when the level of material in any of the hoppers in the system has fallen below a level indicating a need for refilling and automatically controls a conventional crane, as described above, to keep each of the hoppers full. A further problem which has been experienced with the use of a manually operated crane, as described above, is that there may be some slight variation even between bales of the same material. No two bales of cotton are exactly alike, nor are even two bales of synthetic fibers. Accordingly, it is desirable to effect at least some blending of the same kind of material before the blending line is employed for blending different kinds of material. According to one aspect of this invention, this is effected by the apparatus described in detail below and the control circuitry which forms a part thereof by causing the crane to pick up and dump into the hopper of a fiber blending machine which needs fibers, material from each of the plurality of bales which extend behind the hopper as discussed above.

Many other objects and purposes of the invention will become clear from the following detailed description of the drawings.

BRIEF DESCRIPTION OF THE DRAWINGS

FIG. 2 shows a schematic view of the arrangement in FIG. 1 showing the order in which the stations are served by the control circuitry and the order in which material is taken from each of the bales extending behind the hopper of each station.

FIG. 3 shows a schematic view illustrating the travel of the overhead crane which lifts up and transports material over a hopper to be dumped therein.

FIG. 5 shows a view of the sensor and switch for sensing when the overhead crane for picking up the material is down to a position where the fingers can be closed.

DETAILED DESCRIPTION OF THE DRAWINGS

Figure 1:
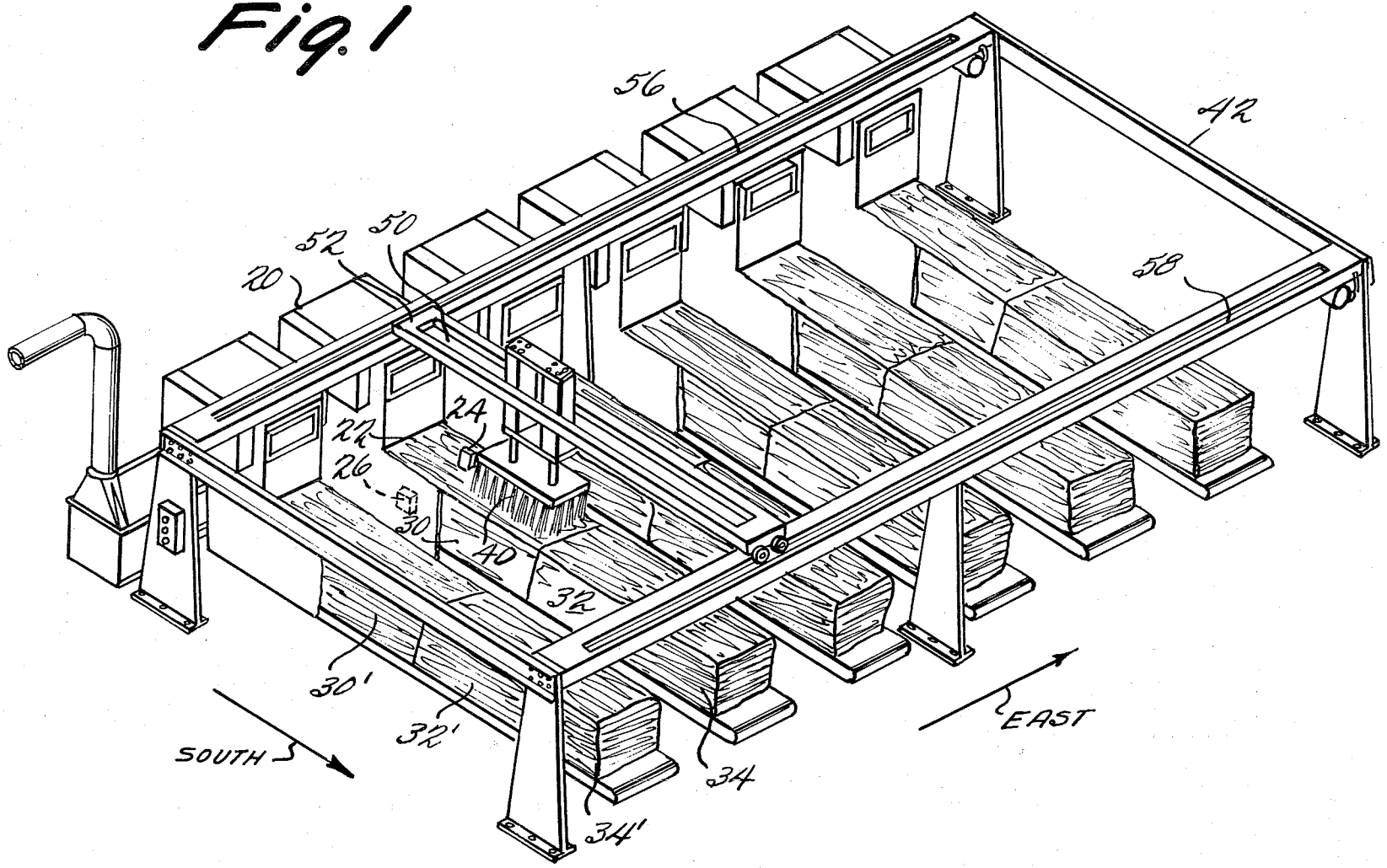
FIG. 1 shows a schematic view of an overhead crane supplying material to each of a plurality of hoppers of blending machines on a blending line from each of a plurality of bales extending behind each hopper.

Reference is now made to FIG. 1 which illustrates a perspective view of an overhead crane for feeding a plurality of stations, each comprising a blending machine which weighs and dumps fibers to create a plurality of fiber sandwiches which can be pneumatically or otherwise distributed to carding or other machines. Each of the blending machines, for example, machine 20, has a hopper 22 behind it for receiving textile fibers, such as cotton, synthetics, etc. A conventional light source 24 provides a light beam extending across each hopper which impinges on a photocell 26 when the level of fibers in hopper 22 is low enough to require refilling. Photocell 26 is in turn included in a conventional circuit which may include a relay for operating a pair of respectively normally open and normally closed switches whenever the light impinges on the photocell, indicating the need for further fibers as discussed below.

A plurality of bales, for example, bales 30, 32 and 34 are located behind each of the fiber blending machines, in this instance machine 20, and more particularly behind hopper 22 and extending transverse to the direction of the fiber blending line. While any suitable number of bales can be employed, five have been found to be convenient, although only three bales are shown in FIG. 1 for convenience in illustration.

A conventional overhead crane having a plurality of fingers 40 which can be conventionally opened and closed by appropriate motors is mounted on frame 42 for movement in each of three directions. The crane and its fingers 40 can be moved up and down within a slot 50 extending along the length of rail 52, and can be likewise moved transverse to the blending line along the direction in which the bales extend in that same slot. Rail 52 can in turn be moved by appropriate motors in slots 56 and 58 which extend parallel to the blending line.

The crane and its fingers 40 can thus be moved in a direction parallel to the blending line to a location in line with a hopper of any of the blending machines and the bales which extend behind it. The crane and its fingers 40 can also move transverse to the direction of that blending line to a position over any of the bales extending behind the hopper. The up-and-down movement which is permitted and the opening and closing of fingers 40 can then be used in conjunction with these first mentioned horizontal movements to pick up and transport a quantity of material from any given bale and drop that material into the hopper behind which it extends.

For understanding this embodiment of the invention, the two transverse horizontal directions have been associated with the compass directions—north, south, east, west. This designation is purely for the purpose of explaining the operation of this embodiment, and the directions have no association with the actual compass directions. Normally, as will be appreciated from the discussion of the control circuitry as discussed below, the crane and its fingers 40 will be in a rest position in one corner of frame 42 adjacent to the hoppers. Movement from this corner along the direction in which the bales extend is termed "north" movement, and movement along the blending line parallel to that line is termed "west" movement.

The control circuitry, as discussed below, which operates the crane is designed to effect movement in a way which has been found to be particularly advantageous, and this programmed movement can be best understood from the schematic of FIG. 2 which illustrates four stations for receiving material, such as textile fibers, and a plurality of sources which may be bale extending behind those stations. As indicated above, the crane is normally in the southeast corner, which is a corner adjacent to the stations. After all of the stations have been served, and when none is demanding further fibers, the crane will return to this initial starting position. When any of the hoppers is requesting additional fiber as the level of material falls below a predetermined level, permitting the light from a source to fall on a photocell in that hopper, the crane moves to supply the demands of that hopper. Accordingly, the crane movement is first west along the direction in which the blending line extends until the crane passes over a station or hopper which is demanding fibers. Assuming in FIG. 2 that station 1 is demanding fibers, the crane then stops its westward movement and is caused to move north until it is over the location of bale No. 1 in FIG. 1. The northward movement is then stopped, and the crane with its open fingers 40 is lowered until it senses the material which is to be picked up. Fingers 40 are then closed and a quantity of the material grasped. Then the crane is moved upward and then southward until it is over the hopper of station No. 1. Next, the crane fingers are opened to dump the picked up material into the hopper. The crane now again travels north until it is over the second bale at which time it moves downward, closes fingers 40 picking up a quantity of material, moves back upward and moves again south until it is over the hopper for station No. 1 at which time dumping occurs. The crane is then moved to the third bale where it picks up material and similarly returns it to be dumped into station No. 1, and then to the fourth and fifth bales in the same fashion. Thus, material from each of the sources or bales is used to fill the hopper, thereby effecting a degree of blending and at the same time assuring that all of the bales will be deplenished at the same time. This eliminates the need for adding new bales one at a time.

After material from each of the five sources has been dumped into the hopper of station No. 1, the crane resumes its westward movement until it is over the next station, for example, station No. 2, which is demanding fiber. If station No. 2 is not demanding fiber, the crane will move onto the next station which is demanding. The same steps as for the station No. 1 are then repeated with material being derived from each of the five sources or bales extending behind that station. When each of the stations which has demanded fibers has been served, the crane reverses its direction and moves eastward back to the initial starting position and stops from which the above steps are repeated as soon as a station demands fibers.

Figure 4:
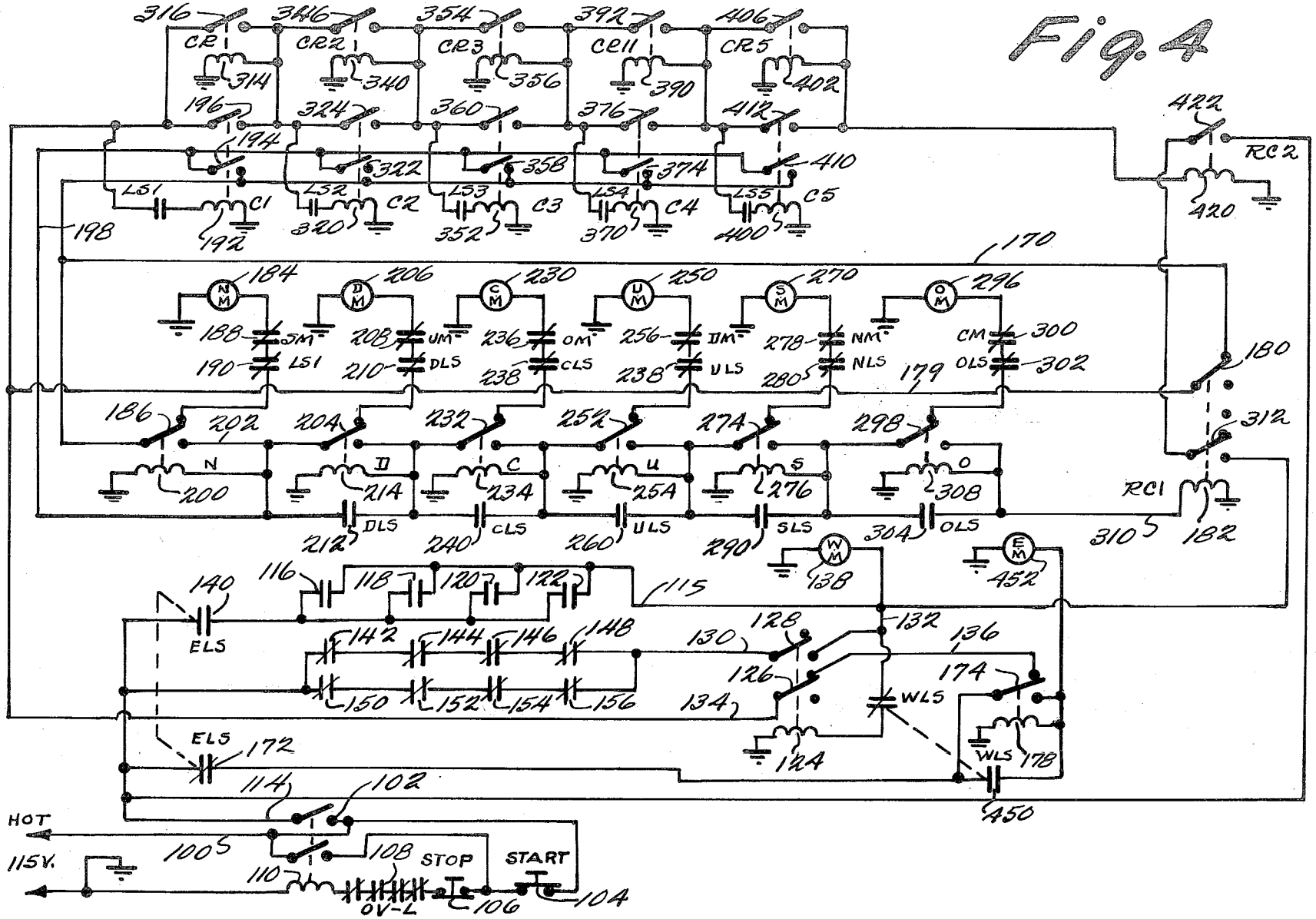
FIG. 4 shows a schematic of the control circuitry of this invention.

Reference is now made to FIG. 3 which illustrates schematically the three dimensional movements of the crane under control of the circuitry illustrated in FIG. 4. As can be seen in FIG. 3, the crane starts from a southeast position and first moves west along the direction in which the blending line extends. The crane can be moved up and down and the fingers opened and closed to dump and pick up material respectively as shown.

Reference is now made to FIG. 4 which illustrates the control circuitry for operating the crane as described above. The power for the circuitry in FIG. 1 is preferably supplied from a 115-volt, alternating current, 60 cycle source with one side grounded as illustrated. Hot line 100 is connected via normally open, start, pushbutton switch 104, normally closed stop, pushbutton switch 106, and a plurality of normally closed overload switches 108, which may be associated with the various motors as described above, to a power on, contacting relay 110. Manually pushing start switch 104 completes a current path through contactor relay 110, closing its controlled switch 102 and creating a latching path through relay 110. Power on, contacting relay 110 also closes its controlled switch 112 to connect line 100 to line 114. Assuming that the crane is then in the southeast corner of the frame in start position, the operation of the circuitry in controlling the supply of materials to the various hoppers will now be explained.

Line 114 is connected to line 115 via a plurality of parallel connected, normally open switches which are each associated with the level sensor in one of the hoppers as discussed above. In the circuitry of FIG. 4, four switches are illustrated and the circuitry has been designed for serving four blending machines. It will be readily apparent how the circuitry can be easily expanded to serve any desired number of machines having any desired number of bales or other material sources associated therewith. When one of the normally open switches 116, 118, 120 or 122 is closed indicating that one of the stations is demanding fibers, line 114 is connected to line 115 via that closed switch, completing a current path through the west relay 124. The resulting activation of west relay 124 shifts its controlled switch 126, as well as controlled switch 128, from their illustrated positions. The shifting of switch 128 completes a current path between lines 130 and 132, and the shifting of switch 126 interrupts the current path between lines 134 and 136. Line 114 is connected to west motor 138, which causes movement of the crane in the west direction along the direction in which the blending line extends, via normally open east limit switch 140 which opens when the crane moves off the initial far east position. The crane thus moves west.

Line 130 is connected to line 114 via a number of normally closed switches 142, 144, 146 and 148 which are each respectively connected in parallel with normally closed switches 150, 152, 154 and 156. Switches 142, 144, 146 and 148 are associated with a sensor which provides a demand signal when the level of material in a respectively associated hopper has fallen below a predetermined level, and the respectively associated switch 142, 144, 146 or 148 is opened when that occurs. Switches 150, 152, 154 and 156 are respectively switches associated with each of the stations in the system and the associated switch is opened when the crane moves to a position over that station. These switches may simply be limit switches which are physically opened when the crane assembly moves over a roller at the station. Thus, switches 142 and 150 and switch 116 are associated with station No. 1; switches 144 and 152, as well as switch 118, are associated with station No. 2, etc.

Thus, switches 150, 152, 154 and 156 maintain the current path through west relay 124 and west motor 138 after switch 140 reopens, until the crane is in line with the hopper of the first station having a sensor indicating a demand for fibers.

If station No. 1 is demanding fibers when the crane moves over that station, the current path between line 114 and line 130 is interrupted. Thus, the current path through west motor 138, as well as west relay 124, is interrupted, and westward movement ceases. The deactivation of relay 124 causes its controlled switches 126 and 128 to return to their illustrated positions. The return of switch 126 to its illustrated, closed position as relay 124 is deactivated connects line 170 to line 114 via normally closed east limit switch 172 which closed as the crane moved off the starting southeast position and moved westward, switch 174 which is controlled by east relay 178 and which is in the illustrated position except at the time the crane moves to the southwest position for return to the starting at the completion of feeding lines 134 and 179 and switch 180 which is controlled by a first recycle relay 182 and which is normally in the position illustrated. As discussed below, recycle relay 182 is activated upon completion of dumping of material from one of the bales into a given hopper to cause the movements which resulted in dumping from that bale into that hopper to be repeated to dump into the same hopper from another bale.

Line 170 is connected to a north motor 184, which causes the crane to move northward, via switch 186 which will be at this time in the illustrated position and safety switches 188 and 190. Switch 188 is a normally closed switch which is closed when the south motor is not in operation and may be associated with the magnetics of that motor. Switch 188 prevents operation of the north and south motors at the same time. Similarly, switch 190 is a limit switch associated with the outermost northern bale or other material source for preventing the north motor from trying to move the crane beyond the northernmost limits of the frame. Activation of north motor 184 then causes the crane to move northward, while the west motor 138 and west relay 124 remain deactivated.

When the crane is over the first bale from which material is to be taken, which is the northernmost bale, normally open limit switch LS1 closes completing a current path through relay 192 which shifts its controlled switches 194 and 196 from their illustrated positions. Switch LS1 as well as the LS2, LS3, LS4 and LS5 switches closed when the crane moves north over each respectively but not when the crane moves south over each. The shifting of switch 194 connects line 170 to line 198 via switch 194 and also completes a current path through north relay 200 which shifts its controlled switch 186 from the illustrated position, interrupting the current path through north motor 184 and terminating northward movement and also connecting line 170 to line 202 via switch 186.

The crane has now been moved northward to a location over the first bale which is furthest from the associated hopper. The shifting of switch 186 completes a current path via switch 204 through down motor 206 via normally closed, control safety switches 208 and 210. Switch 208 is associated with the up motor and prevents both the down and up motors from being operated at the same time. Switch 210 is a down limit switch which, as discussed below, terminates downward movement when fingers 40 are in position to pick up material from the bale. When down limit switch 210 is open and the associated down limit switch 212 closed, indicating the crane is in position to pick up a quantity of fibers, a current path is completed through down relay 214 which shifts its controlled switch 204 from the illustrated position, interrupting the current path through down motor 206.

Reference is now made to FIG. 5 which illustrates one embodiment of a switch which can be used for down limit switches 210 and 212. A rod 220 is mounted within a hollow cylindrical member 222 which is in turn mounted on the crane adjacent fingers 40 so that rod 220 contacts the material, such as a bale of cotton, and is moved upward as the crane descends to the proper position. Rod 220 has a cutout portion 223 in which a conventional pushbutton switch 224 is mounted as shown. When rod 220 has moved upward to a position in which fingers 40 of the crane are situated for picking up the material, whatever the level of the bale, switch 224 is actuated to operate appropriate relays controlling down limit switches 210 and 212. Alternately, these switches may be actually situated for mechanically operating as shaft 220 engages switch 224.

The shifting of switch 204 in FIG. 4 from its illustrated position completes a current path through the close motor 230 via switch 232, which is controlled by close relay 234, and normally closed safety switches 236 and 238. Switch 236 prevents close motor 230 and the open motor from operating at the same time, while switch 238 insures that "close" motor 230 will be shut off when fingers 40 have been closed to hold the material. A similar close limit switch 240 is connected to relay 234 for activating that relay when the fingers have closed. Switches 238 and 240 can be operated by pressure in a vacuum line if vacuum is employed for picking up and holding the material. Alternately, a simple switch which is mounted for operation when the fingers have moved together to a certain separation or for closing when a motor overload condition occurs, indicating that the jaws can move no closer together, can be employed.

When close limit switch 240 has closed, a current path is completed through relay 234 which shifts its switch 232 from its illustrated position, de-energizing close motor 230 and completing a current path through up motor 250 via switch 252 which is controlled by up relay 254, and safety switches 256 and 258. Switch 256 prevents both the down and up motors from being operated at the same time and switch 258 operates as a safety switch to cut off the up motor in the event that up limit switch 260 for some reason fails to sense the up position and activate relay 254. When the crane has returned to the up postion switch 260 closes, completing a current path through relay 254, shifting its controlled switch 252 to complete a current path through south motor 270 via safety switches 278 and 280 and switch 274, which is controlled by relay 276. Switch 278 prevents both the north and south motors from operating at the same time, and switch 280 prevents the south motor from operating after the crane has moved to south to the extent permitted by the frame.

The crane now moves with its load of material southward until it is over the hopper, at which time south limit switch 290 closes to complete a current path through relay 276 which shifts its controlled switch 274, completing a current path through open motor 296 via switch 298 and safety switches 300 and 302. Safety switch 300 prevents the close and open motors from being operated at the same time, and switch 302 assures that the open motor will not for some reason remain stuck. The material which is being held is then released over the hopper and falls therein. When open switch 304 closes, a current path is completed through relay 308 which shifts its controlled switch 298 from the illustrated position.

At this time, relays 200, 214, 234, 254, 276 and 308 are all activated with switches 186, 204, 232, 252, 274 and 298, completing a current path between line 170 and line 310, and through first recycle relay 182 which shifts its controlled switches 180 and 312 from their illustrated positions. The shifting of switch 180 from its illustrated position interrupts the current path retaining relays 200, 214, 234, 254, 276 and 308 activated, and these relays are thus deactivated permitting their controlled switches to return to their illustrated positions so that the above northward, downward, close, up, south and open operations and movements can be repeated with another bale of material which also extends behind the same hopper which is being served. The closing of switch 312 has no effect at this time and operates later as discussed to effect recycling when material from each of the bales associated with a given hopper has been picked up and deposited in the hopper.

The activation of relay 182 and the subsequent shifting of switch 180 also interrupts the current path through first recycle relay 182 itself which shortly thereafter returns its controlled switches to their illustrated positions. The shifting of switch 180 reconnects line 170 to line 114 and again completes a current path through north motor 184 via switches 186, 188 and 190. The crane now returns northward. Further, the closing of switch 196 by the previous activation of relay 192 completed a current path through control relay 314, which shifted its controlled switch 316 from the illustrated open position. Relay 192 was subsequently deactivated as the crane moved southward, opening the limit switch LS1, but relay 314 remained activated as the current path through it was maintained by its controlled latching switch 316. When the crane is over the second most northern bale and the limit switch LS2 associated with that bale closes, a current path is completed through control relay 320 associated with that bale shifting its controlled switches 322 and 324 from their illustrated positions. The shifting of switch 322 again completes a current path between lines 170 and 198, once again completing a current path through relay 200 which shifts its controlled switch 186, terminating operation of north motor 184 and in turn operating down motor 206, close motor 230, up motor 250, south motor 270, and open motor 296 to sequentially carry out these movements and operations and carry material from the second bale over the hopper and drop it into that hopper. At the end of these movements and operations, first recycle relay 182 is again activated to shift its controlled switches 180 and 312 from their illustrated positions and deactivated relays 200, 214, 234, 254, 276 and 308 in preparation for movement to the third most northern bale and picking up material from that bale.

The closing of switch 324 completes a current path through control relay 340 which closes its controlled latching switch 346 so that both relays 314 and 346 remain activated after the activation of first recycle relay 182 and the shifting of switch 180 from its illustrated position. When first recycle relay 182 is deactivated and switch 180 returns to its illustrated position, north motor 184 is again activated and the crane moves northward to the third most northern bale. When the crane is over that third bale, limit switch LS3 associated with that bale is closed to complete a current path through control relay 352. The shifting of switch 358 in response to the activation of relay 352 again completes a current path between lines 170 and 198 via switch 358 to deactivate north relay 200 and to in turn sequentially operate motors 206, 230, 250, 270 and 296 to pick up the material from the third bale, return to the hopper and drop it into the hopper. The shifting of switch 360 activates relay 356 which shifts its controlled switch 354 from the illustrated open position. At the end of these operations, recycle relay 182 is again deactivated.

North motor 184 again operates and the crane resumes its northward movement until it is over the fourth most northern bale, closing limit switch LS4 associated with that bale and completing a current path through relay 370. Relay 370 then shifts its controlled switches 374 and 376 from their illustrated open positions, completing a current path again between lines 170 and 198 and also activating relay 390 which maintains itself activated by a latching controlled switch 392. The above steps are repeated and as soon as relay 184 is activated and thereafter deactivated by the opening of its own switch 182, northward movement is resumed until the crane is over the fifth and most southern bale, closing limit switch LS5 associated with that bale and completing a current path through relay 400. The activation of relay 400 shifts its controlled switches 410 and 412 from their illustrated positions, once more connecting together lines 170 and 198 to deactivate north motor 184 and sequentially operate down motor 206, close motor 230, up motor 250, south motor 270, and open motor 296.

At this time, material has been taken from each of the five bales which are disposed behind the first hopper encountered which had a sensor requesting additional fibers. The circuitry now causes the crane to resume its westward movement until a further station is encountered which is demanding fibers, at which time the above steps are repeated for that station, and material from each of the bales extending behind the station supplied to the hopper.

The closing of switch 406 by relay 402 connects the second recycle relay 420 to line 114 via switch 172, switch 174, switch 126 controlled by west relay 124 and switches 316, 346, 354, 392 and 406. The activation of relay 420 closes its controlled switch 422. When first recycle relay 182 is subsequently activated upon the closing of switch 298 as discussed above, a current path is completed through west relay 124 via switches 312 and 422. West relay 124 then shifts its controlled switches from their illustrated positions, again completing a current path through west motor 138 to resume westward movement until the next station is encountered which is demanding fibers at which time west relay 124 is deactivated and the above steps for supplying material from each of the bales extending behind the station demanding fibers is repeated. The shifting of switch 126 by relay 124 interrupts the current path through recycle relays 182 and 420 which are thus deactivated as are relays 316, 340, 356, 390 and 402. The shifting of switch 128 by relay 124 maintains the current path through relay 124 and motor 138, after relays 182 and 420 are deactivated and return their controlled switches 180, 312 and 422 to their illustrated positions.

When the crane reaches its furthest extent of westward travel, having passed all of the stations, west limit switch 450 closes, completing a current path via normally closed east limit switch 172 through east relay 178, which shifts its controlled switch 174 from its illustrated position, completing a current path through east motor 452 and also preventing further operation of the north, down, close, up, south and open motors until the crane has been returned to its starting position. At the far west position, normally closed west limit switch 454 is also opened to prevent further operation of west motor 138 until the crane has returned to its starting position. Even if stations are now indicating a demand for further material, they will not be served until the crane has returned to its starting position.

When the circuit has returned to the far east starting position, normally closed east limit switch 172 opens, interrupting the current path through east relay 178 which returns its controlled switch 174 to the illustrated position. The cycle for the crane has now been completed and the above operations are repeated whenever any of the stations associated with the system indicate a demand for fibers by operating associated switches 116 and 142, or 118 and 144, or 120 and 146, or 122 and 148.

Manual override switches are preferably provided for operating each of the motors. In the event of a power failure during a cycle these override switches must be manually operated to return the crane to the initial starting position where a new cycle can begin.

The system can be easily adapted for use with any desired number of stations at any desired number of sources of material extending behind that station. While the embodiment is particularly effective for supplying fiber material to blending machines for a blending line as discussed above, it can be used for picking up and conveying a wide variety of materials to a location from which material is at least periodically removed. The system can be used, for example, for moving coal, sand, grain, or other types of textile material and no limitation to the particular use described above is intended. Any suitable switches can be used to carry out the above-described functions.

Many changes and modifications in the above-described embodiment of the invention can of course be made without departing from the scope thereof. Accordingly, that scope is intended to be limited only by the scope of the appended claims.

What is claimed is:

1. In a control circuit for operating an overhead crane mounted on a frame for movement vertically and in horizontal directions to pick up material from one of a number of sources, transport that material and permit it to drop onto one of a number of given locations from which the material is removed, there being at each said location means for sensing the level of material at each of said locations and providing a demand signal when that level is less than a predetermined level, the improvement in means for automatically causing said crane to move to supply material to each of said locations having a sensing means providing a demand signal so that each location is supplied with material from a plurality of sources, comprising:

a plurality of electric motors including a north motor for moving the crane in a first horizontal direction, a south motor for moving the crane in a second horizontal direction opposite to said first direction, an east motor for moving the crane in a third horizontal direction transverse to said first and second directions, a west motor for moving the crane in a fourth direction opposite to said third direction, an up motor for raising said crane, a down motor for lowering said crane, a close motor for causing a quantity of said material to be picked up and an open motor for causing a quantity of said material to be released west means connected to said sensing means for completing a current path through said west motor whenever any one of said sensing means is producing a demand signal so that said crane is moved in said fourth direction, and for interrupting the current path through said west motor when said crane is in line with a given location having a sensing means producing a demand signal, means for completing a current path through said north motor when said current path through said west motor is interrupted so that said crane moves in said first direction, indicating means having an output condition indicating from which source material is to be picked up, north means for interrupting the current path through said north motor when said crane is over the source indicated by said indicating means and completing a current path through said down motor, down sensing means for sensing when said crane has moved down to a position for picking up material and providing a down signal, down means connected to said down sensing means for interrupting the current path through said down motor when said down sensing means provides said down signal, and for completing a current path through said close motor, close means for interrupting the current path through said close motor when said material is held and completing a current path through said up motor, up means for interrupting the current path through said up motor when said crane is up and completing a current path through said south motor so that said crane moves in said second direction, south means for interrupting the current path through said south motor when said crane is over the given location and completing a current path through said open motor, open means for interrupting the current path through said open motor after the picked material has fallen at the given location, first recycle means for recompleting a current path through said north motor to repeat the above until said indicating means indicates enough material has been picked up from said indicated source for said given location and released by said open means at said given location, second recycle means for recompleting a current path through said west motor to cause said crane to move in said fourth direction until said crane is in line with another given location having a sensing means producing a demand signal, and east means for completing a current path through said east motor to cause said crane to move in said third direction, when said crane has moved past all of said given locations, back to the initial position, wherein said west means includes:

a plurality of normally open sensing switches connected in parallel and serially with said west motor, each switch being respectively associated with a sensing means and shifting to a closed position when the associated sensing means is producing a demand signal, a normally open east limit switch serially connected with said plurality of sensing switches, a west relay connected to said west motor having first and second controlled switches, a second plurality of serially connected sensing switches which are each normally closed and respectively associated with a sensing means and shifting to an open position when the associated sensing means is producing a demand signal, and a plurality of normally closed serially connected position switches connected in parallel with said second plurality of serially connected sensing switches and opening respectively when the crane is in line with an associated given location, said west motor being connected in series with said first controlled switch and therethrough to said second plurality of sensing switches.

2. A circuit as in claim 1 wherein said north means includes a north relay having a controlled switch connecting in a first position to said north motor and connected to said first controlled switches of said second relay so that said north relay is activated to shift its controlled switch to a second position maintaining said north relay activating when one of said first controlled switches of said second relay is closed and wherein said down, close, up, south and open means each includes a relay having a controlled switch connected in a first position to the respective down, close, up, south, and open motors for completing a current path through these motors in turn with the controlled switches being serially connected with each other in the second position, and for activating said down, close, up, south and open relays respectively and sequentially to shift each controlled switch in turn to the second position maintaining the associated relay activated.

3. A circuit as in claim 2 wherein said indicating means includes a plurality of first indicating relays each having a latching, controlled switch connected serially with each other, a plurality of second relays each having a first normally open controlled switch connected in parallel with each other and a second controlled switch serially connected with each other and connecting respectively to said first indicating relays.

4. A circuit as in claim 3 wherein said first recycle means includes a first recycle relay having first and second controlled switches said first recycle relay being connected to said controlled switches of said north, down, close, up, south and open relays so that said first recycle relay is activated when all of said north, down, close, up, south and open relays have controlled switches in said second position, said first controlled switches thereof serially connected in the current path maintaining said north, down, close, up, south, and open relays activated.

5. A circuit as in claim 4 wherein said second recycle means includes a second recycle relay activated by a current path through said second controlled switches of said second indicating relays and having first and second controlled switches with one of its controlled switches and said second switch of said first recycle relay recompleting a current path through said west motor and said west relay and interrupting the current path through said first and second indicating relays and through said north, down, close, up, south and down relays when said first and second recycle relays are both activated.

6. A circuit as in claim 5 wherein said east means includes an east relay having an east controlled switch for shifting from a first position in the current path to said west, north, down, close, up, south and open motors and relays and said first and second indicating relays to a second position connecting to said east motor and latching said east relay when activated, a west limit switch connected to said east relay for activating said east relay at a far west position, and switch means for interrupting the current path through said east relay when said crane has returned to its initial position.

* * * * *